US005904120A

United States Patent [19]

Ban et al.

[11] Patent Number: 5,904,120

[45] Date of Patent: May 18, 1999

[54] VISCOUS HEATER

[75] Inventors: Takashi Ban; Hidefumi Mori; Kiyoshi Yagi; Tatsuya Hirose, all of Kariya, Japan

[73] Assignee: Kabushiki Kaisha Toyoda Jidoshokki Seisakusho, Kariya, Japan

[21] Appl. No.: 08/973,621

[22] PCT Filed: Mar. 26, 1997

[86] PCT No.: PCT/JP97/01027

§ 371 Date: Dec. 4, 1997

§ 102(e) Date: Dec. 4, 1997

[87] PCT Pub. No.: WO97/37865

PCT Pub. Date: Oct. 16, 1997

[30] Foreign Application Priority Data

Apr. 8, 1996 [JP] Japan ..... 8-084891

[51] Int. Cl.[6] ..... F22B 3/06

[52] U.S. Cl. ..... 122/26; 126/247

[58] Field of Search ..... 122/26; 126/247; 123/142.5 R

[56] References Cited

U.S. PATENT DOCUMENTS 5,573,184 11/1996 Martin ..... 237/12.3

*Primary Examiner*—Teresa Walberg
*Assistant Examiner*—Gregory A. Wilson
*Attorney, Agent, or Firm*—Morgan & Finnegan, L.L.P.

[57] ABSTRACT

This invention provides a viscous heater which can attain an improvement in heat generating efficiency while preventing leakage caused by expansion of a viscous fluid. For this purpose, a disk-shaped rotor is employed, and a front housing body, a front plate, a rear plate, and a rear housing body constitute housings, and these are stacked and fastened together by through bolts. Surplus spaces in the shape of concaves are formed in the front plate between the respective through bolts and water passages so as to communicate with the heat generating chamber in their outer circumference.

11 Claims, 4 Drawing Sheets

VISCOUS HEATER

TECHNICAL FIELD

The present invention relates to a viscous heater in which a viscous fluid is caused to generate heat by shearing. The resulting heat is utilized as a thermal source for heating by carrying out heat exchange with a circulating fluid which circulates in a radiator chamber.

BACKGROUND ART

Conventionally, a viscous heater used in a vehicular heating apparatus is disclosed in Japanese Unexamined Patent Publication (KOKAI) No.2-246,823. In regard to this viscous heater, a front housing and a rear housing are disposed so as to face each other, and fastened together by through bolts, thereby forming therein a heat-generating chamber, and a water jacket which is disposed around an outer region of the heat-generating chamber. In the water jacket, circulating water is circulated so that it is taken in through a water inlet port and that it is delivered out to an external heating circuit through a water outlet port. In the front housing, a driving shaft is held rotatably via a bearing device. On this driving shaft, a rotor is fixed so that it can rotate in the heat-generating chamber. A wall surface of the heat-generating chamber and an outer surface of the rotor constitute labyrinth grooves which approach to each other. In a space between the wall surface of the heat-generating chamber and the outer surface of the rotor, a viscous fluid, such as a silicone oil, is disposed.

In this viscous heater assembled into a vehicular heating apparatus, when the driving shaft is driven by an engine, the rotor is rotated in the heat-generating chamber. Accordingly, the viscous fluid is caused to generate heat by shearing in the space between the wall surface of the heat-generating chamber and the outer surface of the rotor. The heat thus generated is transferred to the circulating water in the water jacket, and the heated circulating water is used in the heating circuit, to heat a cabin of a vehicle or the like.

In the above conventional viscous heater, however, when a sufficient volume of viscous fluid to make a rotor completely immersed therein is contained in order to improve heat generating efficiency by using the rotor with a certain radius effectively, the viscous fluid is expanded in generating heat and tends to leak from the heat-generating chamber to the outside of the housing.

In this respect, it is conceivable to employ a construction in which the heat-generating chamber communicates with the atmosphere in order to allow expanded viscous fluid to be absorbed by the atmosphere. In this case, however, because moisture in the atmosphere tends to be supplied to the viscous fluid and degrade the viscous fluid, a decrease in heat-generating efficiency is expected. Therefore, it is not preferable to employ this type of construction.

It is an object of the present invention to provide a viscous heater which can attain an improvement in heat-generating efficiency, while preventing leakage caused by expansion of the viscous fluid.

SUMMARY OF THE INVENTION

A viscous heater according to one embodiment of the invention comprises a front housing and a rear housing forming therein a heat-generating chamber and a radiator chamber which adjoins the heat-generating chamber and in which a circulating fluid is circulated; a driving shaft held rotatably by the front housing by way of a bearing device;

a rotor disposed in the heat-generating chamber and rotatable by the driving shaft; and a viscous fluid disposed in a space between a wall surface of the heat-generating chamber and an outer surface of the rotor, and caused to generate heat by rotation of the rotor, wherein at least one of the front housing and the rear housing is provided with a surplus space which communicates with the heat-generating chamber and permits thermal expansion of the viscous fluid.

In the viscous heater according to the invention, when a viscous fluid is contained only a certain ratio of the sum of the volume of the heat-generating chamber in itself and the volume of the surplus space, a large volume of viscous fluid is contained. As a result, degradation of the viscous fluid is retarded and a longer lifetime of the viscous heater is attained. In the case of this viscous heater, even when a sufficient volume of viscous fluid is contained and the rotor is completely immersed in the viscous fluid in order to utilize the rotor with a certain radius effectively, the air in the surplus space which communicates with the heat-generating chamber permits thermal expansion of the viscous fluid.

Therefore, the viscous heater according to the invention can realize an improvement in heat generating efficiency, while preventing leakage caused by expansion of the viscous fluid.

The heat-generating chamber and the surplus space may be in a closed state and enclose the viscous fluid.

Because the heat-generating chamber and the surplus space do not communicate with the atmosphere, the viscous fluid is prevented from degrading due to moisture in the atmosphere and heat generating efficiency of the viscous fluid is maintained.

A viscous heater according to claim 3 is characterized in that, in the viscous heater as set forth in claim 1 or 2, the surplus space may be formed in an outer circumferential region of the heat-generating chamber.

When the rotor is kept rotating, the viscous fluid in the heat-generating chamber is rotated in a direction perpendicular to the liquid surface, and so exercises the Weissenberg effect in which the viscous fluid concentrates around an axis against centrifugal force. This Weissenberg effect is assumed to be produced by the normal stress effect. Therefore, if the surplus space is formed in at least one of the front and the rear of the heat-generating chamber, the viscous fluid concentrates in the surplus space while the rotor is driven, and accordingly the surplus space cannot permit thermal expansion of the viscous fluid. In addition, if the surplus space is formed in such a position, shearing of the viscous fluid is largely obstructed by the surplus space, and the heat-generating efficiency also deteriorates.

In this respect, because the surplus space is formed in an outer circumferential region of the heat-generating chamber, the viscous fluid does not concentrate in the surplus space due to the Weissenberg effect while the rotor is driven, and the surplus space in the outer circumferential region can securely permit thermal expansion. In addition, because the surplus space is formed in such a position, shearing of the viscous fluid is not obstructed almost at all by the surplus space, and the heat generating efficiency is maintained.

Since the surplus space is formed in an outer circumferential region of the heat-generating chamber, the length of an axis is not large and the viscous heater is superb in terms of boardability on a vehicle.

Note that the surplus space may be formed as a separate space from the heat-generating chamber, or, may be formed as an integral space with the heat-generating chamber by enlarging a space between an inner circumferential wall surface of the heat-generating chamber and an outer circumferential surface of the rotor.

The surplus space may be formed by enlarging a space between an inner circumferential wall surface of the heat-generating chamber and an outer circumferential surface of the rotor.

Because the surplus space is formed as an integral space with the heat-generating chamber, the surplus space can be formed more easily than if formed as a separate space, and accordingly a decrease in production costs is achieved.

Here, the inner circumference and outer circumference of the heat-generating chamber means not only an outer surface of a cylindrical shape but also outer surfaces (surfaces extending approximately in an axial direction) of the heat-generating chamber and the rotor in any desired shape. The space between the inner circumferential wall surface of the heat-generating chamber and the outer circumferential surface of the rotor can be enlarged partially or all around the circumference. When the space is enlarged partially, it is preferable that the surplus space is formed only above the rotor. It is also preferable that a plurality surplus spaces are provided, because such surplus spaces hardly obstruct shearing of the viscous fluid.

The surplus may also be formed above the rotor.

Since the surplus space is formed above the rotor, for example, when the viscous heater is horizontally boarded on a vehicle so that the driving shaft lies horizontal, both the front and rear end surfaces of the rotor are completely immersed in the viscous fluid and an improvement in heat generating efficiency can be attained.

The front housing and the rear housing may be fastened together in an outer circumferential region of the heat-generating chamber by a plurality of through bolts, and surplus spaces are dotted between the respective through bolts.

Because surplus space are dotted in portions which exist between the respective through bolts and which are provided to facilitate production, the outer diameter of the whole viscous heater in a radial direction does not become large and the viscous heater is superb in terms of boardability on a vehicle.

The radiator chamber comprises a front radiator chamber formed in front of the heat generating chamber, and a rear radiator chamber which communicates with the front radiator chamber by a plurality of axially-extending fluid passages and which is formed at the back of the heat generating chamber, and surplus spaces are dotted between the respective fluid passages.

A front radiator chamber and a rear radiator chamber secure sufficient heat exchange with the circulating fluid. In addition, because surplus spaces are disposed between respective fluid passages which connect the front radiator chamber and the rear radiator chamber, the outer diameter of the whole viscous heater in a radial direction does not become large and the viscous heater is superb in terms of boardability on a vehicle.

At least one of the front housing and the rear housing may comprise a plate one axial-end surface of which forms one wall surface of the heat generating chamber, and the other axial-end surface of which forms one wall surface of the radiator chamber; and a housing body constituting the rest of the housing, the rotor may have the shape of a plate, and the plate, the housing body, and the other of the front housing and the rear housing may be respectively stacked.

Therefore, in this viscous heater, the plate and the housing body have simple shapes and can be assembled easily. Accordingly, a decrease in production costs can be attained.

The rear housing may have a control chamber which communicates with a central region of the heat-generating chamber, and in decreasing the heating power, recovery of the viscous fluid from the heat-generating chamber to the control chamber is conducted at least by the Weissenberg effect of the viscous fluid.

When the viscous fluid in the heat-generating chamber is recovered in a control chamber at least by the Weissenberg effect, the value of heat generated in the space between the wall surface of the heat generating chamber and the outer surface of the rotor is lessened (the heating power is decreased), and the heating performance is lessened. At this time, the air remaining at the surplus space, which has been expanded and pressurized by the heat generation of the viscous fluid, smoothly delivers the viscous fluid to the control chamber.

In contrast, when the viscous fluid in the control chamber is supplied to the heat generating chamber, the value of heat generated in the space between the wall surface of the heat generating chamber and the outer surface of the rotor is increased (the heating power is increased), and the heating performance becomes greater. At this time, the air remaining in the surplus space, which has been shrunk and depressurized by the cooling of the viscous fluid, smoothens the supply of the viscous fluid to the heat generating chamber.

Thus, this viscous heater can smoothly exercise heating power control.

BEST MODES FOR CARRYING OUT THE INVENTION

Hereinafter, first to third preferred embodiments which embody the invention set forth in the respective claims will be described with reference to the drawings.

The First Preferred Embodiment

Figure 1:
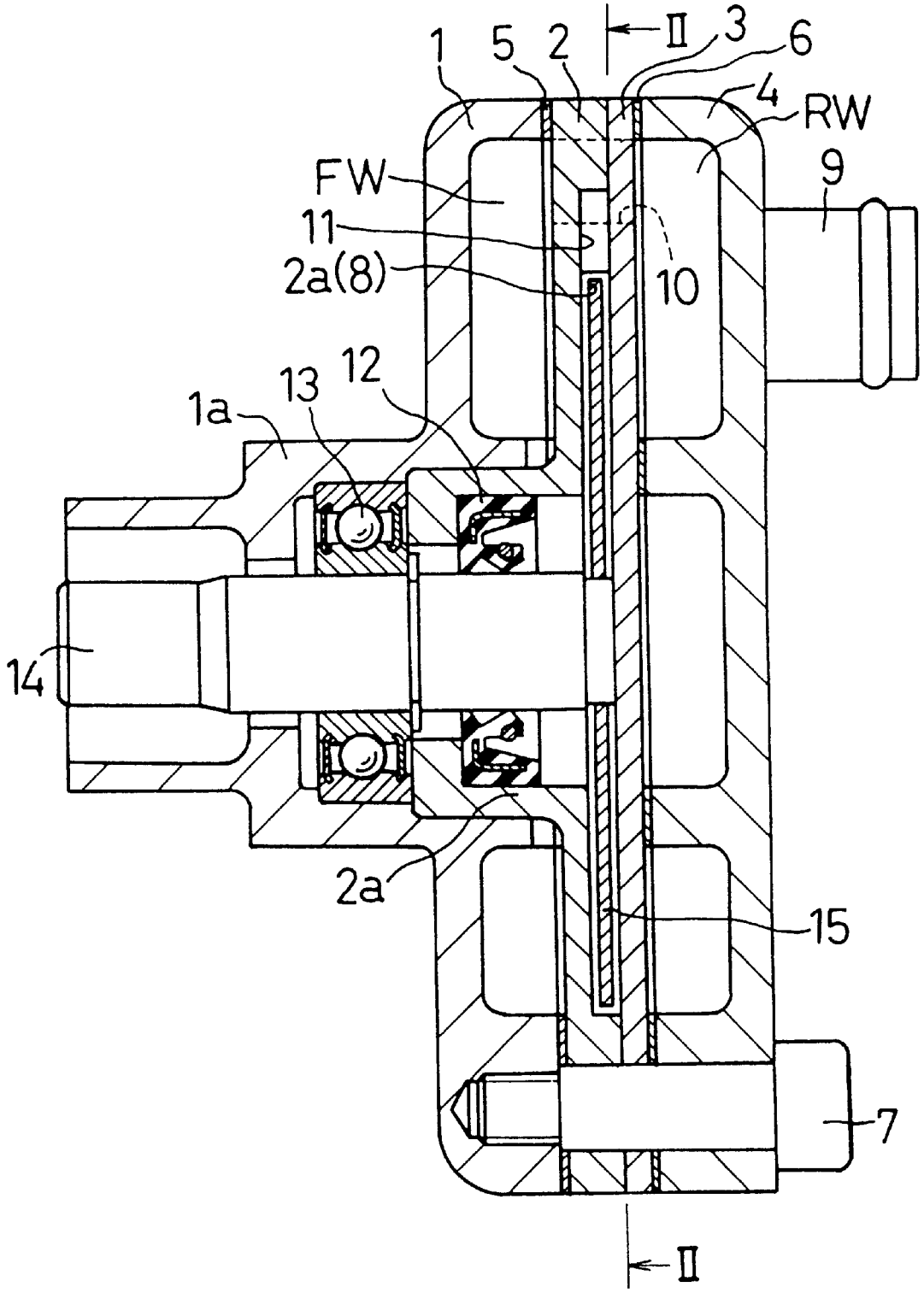
FIG. 1 is a vertical cross-sectional view of a viscous heater according to a first preferred embodiment.

In regard to this viscous heater, as shown in FIG. 1, in order to facilitate production, a front housing body 1, a front plate 2, a rear plate 3, and a rear housing body 4 are respectively stacked and fastened by a plurality of through bolts 7, with a gasket 5 interposed between the front housing body 1 and the front plate 2, and a gasket 6 interposed between the rear plate 3 and the rear housing body 4. Here, the front housing body 1 and the front plate 2 constitute a front housing, while the rear plate 3 and the rear housing body 4 constitute a rear housing. A concave portion 2*a* formed on a rear end surface of the front plate 2 together with a flat front end surface of the rear plate 3 constitutes a heat generating chamber 8 held in a closed state.

An inner surface of the front housing body 1 and a front end surface of the front plate 2 constitute a front water jacket FW which adjoins the front of the heat generating chamber 8 and serves as a front radiator chamber. A rear end surface of the rear plate 3 and an inner surface of the rear housing body 4 constitute a rear water jacket RW which adjoins the rear of the heat generating chamber 8 and serves as a rear radiator chamber.

Figure 2:
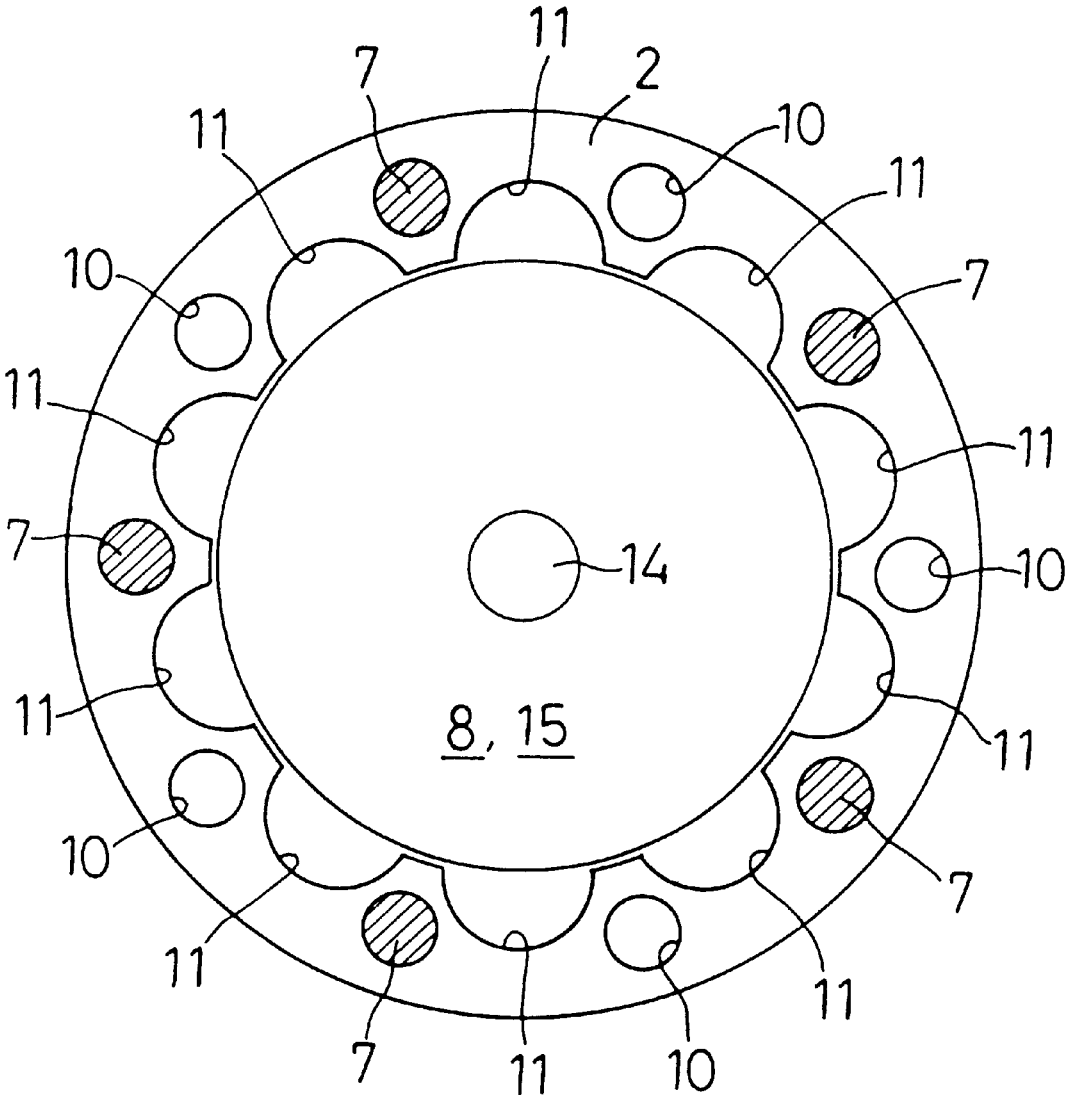
FIG. 2 is a cross-sectional view of the viscous heater according to the first preferred embodiment, taken in the direction of the arrows along line II—II of FIG. 1.

An inlet port 9 and an outlet port not shown are formed adjacently in an outer region of a rear surface of the rear housing body 4. The inlet port 9 and the outlet port communicate with the rear water jacket RW. In the rear plate 3 and the front plate 2, a plurality of water passages 10 serving as fluid passages are formed at regular intervals and between the respective through bolts 7, as shown in FIG. 2. These water passages 10 connect the front water jacket FW and the rear water jacket RW. Since the space between an inner circumferential wall surface of the heat generating chamber 8 and an outer circumferential surface of a rotor 15 mentioned later is partially enlarged in an outer circumferential region of the heat generating chamber 8, a plurality of surplus spaces 11 which are integrally connected with the heat generating chamber 8 in their inner circumference are disposed between the respective through bolts 7 and the respective water passages 10, and formed in a closed state in concaves.

As illustrated in FIG. 1, a shaft seal apparatus 12 is provided in a boss 2*a* of the front plate 2 so as to adjoin the heat generating chamber 8, while a bearing device 13 is provided in a boss 1*a* of the front housing body 1. A driving shaft 14 is rotatably held via the shaft seal apparatus 12 and the bearing device 13. A disk-shaped rotor 15 which can rotate in the heat generating chamber 8 is press-fitted on a rear end of the driving shaft 14. A silicone oil as a viscous fluid exists in the space between the wall surface of the heat generating chamber 8 and the outer surface of the rotor 15, and the surplus spaces 11 in lower positions. A pulley or an electromagnetic clutch not shown is provided on a fore end of the driving shaft 14, and rotated by an engine of a vehicle by way of a belt. In this case, this viscous heater is horizontally boarded in an engine room so that the driving shaft 14 lies horizontal.

When this viscous heater assembled in a heating apparatus of a vehicle, and the driving shaft 14 is driven by an engine via the pulley or the like, the rotor 15 is rotated in the heat generating chamber 8 and therefore the silicone oil generates heat by shearing in the space between the wall surface of the heat generating chamber 8 and the outer surface of the rotor 15. The heat thus generated is sufficiently transferred to a circulating water serving as a circulating fluid in the rear water jacket RW and the front water jacket FW. The heated circulating water is used in a heating circuit, to heat a cabin of the vehicle or the like.

Herein, in the viscous heater of this preferred embodiment, the silicone oil is contained only in approximately 80% of the sum of the volume of the heat generating chamber 8 in itself and the volume of all the surplus spaces 11. Therefore, when compared with a viscous heater which has no surplus spaces and contains the silicone oil only in approximately 80% of the volume of the heat generating chamber in itself, the viscous heater of this preferred embodiment contains a larger volume of silicone oil, and therefore degradation of the silicone oil is retarded and a longer lifetime of the viscous heater is attained.

In this viscous heater, because the heat generating chamber 8 and the respective surplus spaces 11 do not communicate with the atmosphere, the silicone oil is prevented from degrading due to moisture in the atmosphere and the heat generating efficiency of the silicone oil is maintained.

Further, because the viscous heater of this preferred embodiment is horizontally boarded on the vehicle, the air remains in the upper surplus spaces 11 in about 20% of the volume of the rest. Therefore, when compared with a viscous heater which has no surplus spaces and contains the air in about 20% of the volume of the rest in the heat generating chamber in itself, in the viscous heater of this preferred embodiment, the heat generating chamber 8 in itself is completely filled with the silicone oil and the front and rear end surfaces of the rotor 15 are completely immersed in the silicone oil. Therefore, in the viscous heater of this preferred embodiment, the rotor 15 with a certain radius is effectively used and improved in the heat generating efficiency, while the air remaining in the upper surplus spaces 11 permits thermal expansion of the silicone oil.

Besides, when the rotor 15 is kept rotating, the silicone oil in the heat generating chamber 8 tends to concentrate in the central region due to the Weissenberg effect. In this viscous heater, however, since the surplus spaces 11 are formed in the outer circumferential region of the heat generating chamber 8, the silicone oil does not concentrate in the surplus spaces 11 by the Weissenberg effect while the viscous heater is driven, and the surplus spaces 11 in the outer circumferential region can securely permit thermal expansion. In addition, because the respective surplus spaces 11 are disposed in these positions, the surplus spaces 11 do not obstruct shearing of the silicone oil almost at all and the heat generating efficiency is maintained.

Therefore, this viscous heater can attain an improvement in heat generating efficiency while preventing leakage of the silicone oil due to expansion.

Moreover, in this viscous heater, because the surplus spaces 11 are formed in the outer circumferential region of the heat generating chamber 8, the length of an axis is small when compared with a viscous heater which has surplus spaces in front and at the back of the heat generating chamber 8. Besides, since the surplus spaces 11 are disposed between the respective through bolts 7 and the respective water passages 10, the outer diameter of the whole viscous heater in a radial direction is not increased when compared with a viscous heater which has surplus spaces in the outer circumferential region of the heat generating chamber 8 except for these positions.

Therefore, this viscous heater is superb in terms of boardability on a vehicle.

Further, in this viscous heater, the front plate 2, the rear plate 3, the front housing body 1 , and the rear housing body 4 are simple in shape and easy to be assembled, and the surplus spaces 11 can be formed as integral spaces with the heat generating chamber 8. Therefore, production costs can be reduced.

Furthermore, in this viscous heater, since the surplus spaces 11 are produced by forming concaves in the front plate 2, the weight of this viscous heater is reduced.

The Second Preferred Embodiment

Figure 3:
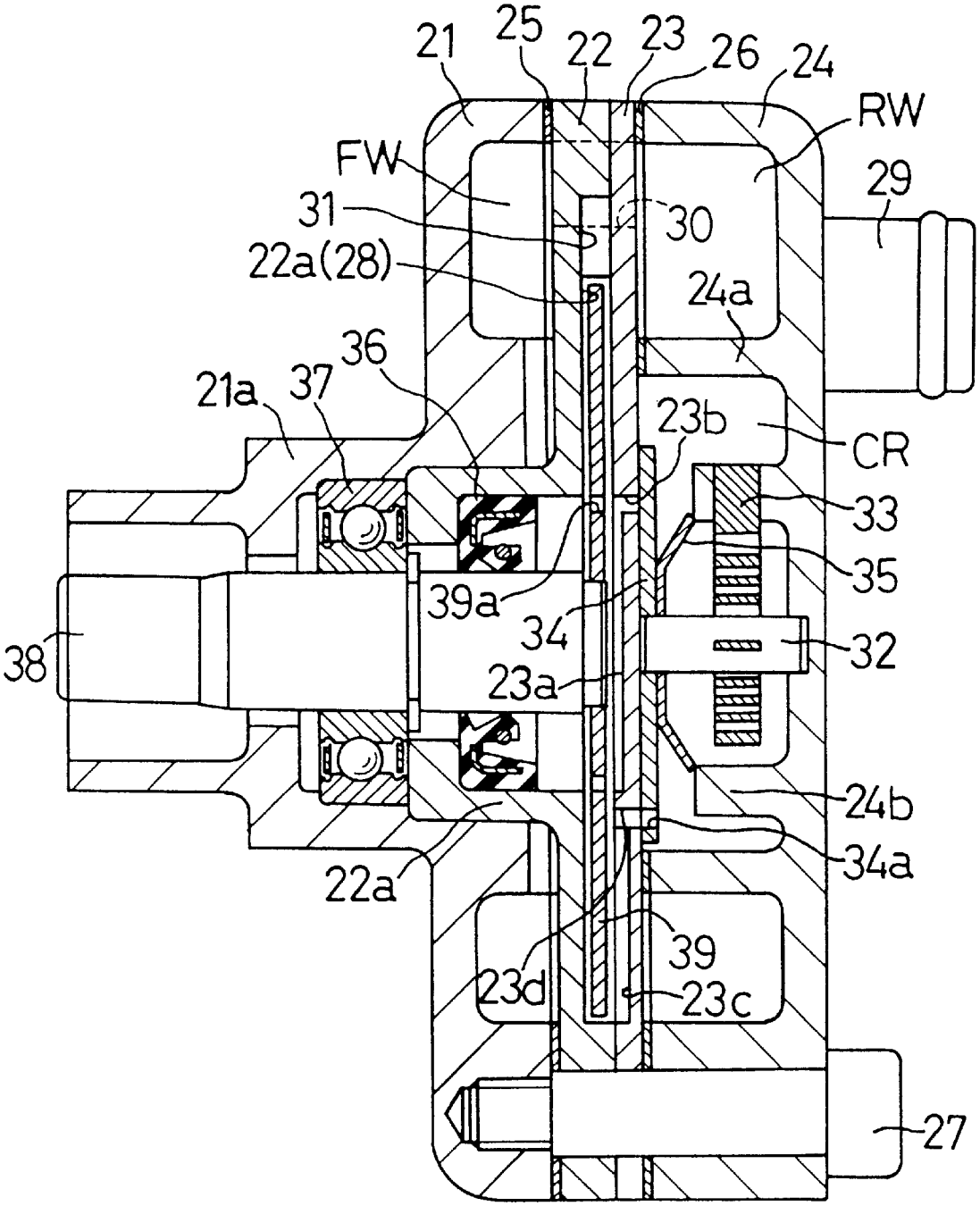
FIG. 3 is a vertical cross-sectional view of a viscous heater according to a second preferred embodiment.

In regard to this variable heating power viscous heater, as shown in FIG. 3, in order to facilitate production, a front housing body 21, a front plate 22, a rear plate 23, and a rear housing body 24 are respectively stacked and fastened together by a plurality of through bolts 27 with a gasket 25 interposed between the front housing body 21 and the front plate 22, and a gasket 26 interposed between the rear plate 23 and the rear housing body 24. Here, the front housing body 21 and the front plate 22 constitute a front housing, while the rear plate 23 and the rear housing body 24 constitute a rear housing.

A concave portion 22*a* formed on a rear end surface of the front plate 22 together with a flat front end surface of the rear plate 23 constitute a heat generating chamber 28. A recovery concave portion 23*a* is formed on the front end surface of the rear plate 23 so as to face a central region of the heat generating chamber 28. A first recovery hole 23*b* is formed in an outer position of the recovery concave portion 23*a* in a manner to penetrate to the rear end surface. In addition, on the front end surface of this rear plate 23, a supply groove 23*c* is extended from the lower outer side of the recovery concave portion 23*a* to the lower outer region of the heat generating chamber 28, and a first supply hole 23*d* is formed in an inner position of the supply groove 23*c* in a manner to penetrate also to the rear end surface.

An inner surface of the front housing body 21 and a front end surface of the front plate 22 constitute a front water jacket FW which adjoins the front of the heat generating chamber 28 and serves as a front radiator chamber. On the other hand, a first rib 24*a* in an annular shape is protrusively formed on the rear housing body 24 so as to contact the gasket 26. A rear end surface of the rear plate 23 and an inner surface of the rear housing body 24 outside of the first rib 24*a* constitute a rear water jacket RW which adjoins the rear of the heat generating chamber 28 and serves as a rear radiator chamber. At the same time, the rear end surface of the rear plate 23 and an inner surface of the rear housing body 24 inside of the first rib 24*a* constitute a control chamber CR which communicates with the recovery concave portion 23*a* and the first supply hole 23*d*.

An inlet port 29 and an outlet port not shown are formed adjacently on the rear surface of the rear housing body 24, and the inlet port 29 and the outlet port communicate with the rear water jacket RW. A plurality of water passages 30 serving as fluid passages are formed at equal intervals between the respective through bolts 27 in a manner to penetrate the rear plate 23 and the front plate 22. The water passages 30 connect the front water jacket FW with the rear water jacket RW. A plurality of surplus spaces 31 which communicate with the heat generating chamber 28 at the inner circumference are formed in the shape of concaves in the front plate 22 and disposed between the respective through bolts 27 and the respective water passages 30, in the same way as in the first preferred embodiment.

A second rib 24*b* in an annular shape is protrusively formed in the control chamber CR of the rear housing body 24, and a valve stem 32 is rotatably held in the center of the second rib 24*b*. An outer end of a bimetal spiral spring 33 serving as a temperature-responsive actuator is engaged with the second rib 24*b*, and an inner end of the bimetal spiral spring 33 is engaged with the valve stem 32. For this bimetal spiral spring 33, certain temperatures for displacement are set based on whether the heating temperature is excessively higher or excessively lower than predetermined heating temperatures. At a fore end of the valve stem 32, a disk-shaped rotary valve 34 is fixed.

This rotary valve 34 is urged by a disk spring 35 which uses the front end surface of the second rib 24*b* as a washer surface, in a direction to close the openings of the first recovery hole 23*b* and the first supply hole 23*d* on the side of the control chamber CR. This rotary valve 34 is provided with an arcuate second recovery hole not shown and a second supply hole 34*a* which can be connected to the first recovery hole 23*b* or the first supply hole 23*d*, in accordance with the turning angle of the rotary valve 34.

Moreover, a shaft seal apparatus 36 is provided in the boss 22*a* of the front plate 22, so as to adjoin the heat generating chamber 28. A bearing device 37 is provided in a boss 21*a* of the front housing body 21. By way of this shaft seal apparatus 36 and this bearing device 37, a driving shaft 38 is rotatably held, and a plate-shaped rotor 39 which can rotate in the heat generating chamber 28 is press-fitted on a rear end of the driving shaft 38. The central region of the rotor 39 is provided with a plurality of communicating holes 39a which penetrate through the rotor 39. A silicone oil as a viscous fluid is provided in the space between the wall surface of the heat generating chamber 28 and the outer surface of the rotor 39, in lower surplus spaces 31, and in the control chamber CR in the extent that most of the bimetal spiral spring 33 is immersed in the silicone oil. A pulley or an electromagnetic clutch not shown is provided on a fore end of the driving shaft 38, and rotated by an engine of a vehicle by way of a belt. In this case, this viscous heater is horizontally mounted in an engine room so that the driving shaft 38 lies horizontal Also with respect to this variable heating power viscous heater assembled in a heating apparatus of a vehicle, when the driving shaft 38 is driven by an engine, the rotor 39 is rotated in the heat generating chamber 28. As a result, the silicone oil generates heat by shearing in the space between the wall surface of the heat generating chamber 28 and the outer surface of the rotor 39. The heat thus generated is transferred to the circulating water as a circulating fluid in the front water jacket FW and the rear water jacket RW, and the heated circulating water is used in a heating circuit, to heat a cabin of the vehicle or the like.

In the meanwhile, if the rotor 39 is kept rotating, the silicone oil in the heat generating chamber 28 tends to concentrate in the central region due to the Weissenberg effect. Here, when the temperature of the silicone oil in the control chamber CR is low, the heating performance is excessively poor and therefore, the bimetal spiral spring 33 does not connect the second recovery hole to the first recovery hole 23*b*, but does connect the second supply hole 34*a* to the first supply hole 23*d*. As a result, the silicone oil in the heat generating chamber 28 is not recovered in the control chamber CR through the recovery concave portion 23*a*, the first recovery hole 23*b* and the second recovery hole. On the other hand, the silicone oil which has been recovered in the control chamber CR is supplied to the heat generating chamber 28 through the second supply hole 34*a*, the first supply port 23*d*, and the supply groove 23*c*. In this case, the silicone oil in the control chamber CR tends to be delivered to the space between the front wall surface of the heat generating chamber 28 and the front surface of the rotor 39 through the communicating hole 39*a*. When the silicone oil is supplied in the space between the wall surface of the heat generating chamber 28 and the outer surface of the rotor 39, the value of heat generated in the space between the wall surface of the heat generating chamber 28 and the outer surface of the rotor 39 is increased (the heating power is increased) and the heating performance becomes greater. In this case, the air remaining in the upper surplus spaces 31, which has been shrunk and depressurized by the cooling of the silicone oil, helps smooth supply of the silicone oil to the heat generating chamber 28.

On the other hand, when the temperature of the silicone oil in the control chamber CR is high, the heating power is excessively great, and therefore the bimetal spiral spring 33 does connect the second recovery hole to the first recovery hole 23*b* but does not connect the second supply hole 34*a* to the first supply hole 23*d*. As a result, the silicone oil in the heat generating chamber 28 is recovered in the control chamber CR through the recovery concave portion 23*a*, the first recovery hole 23*b* and the second recovery hole. At this time, the silicone oil between the front wall surface of the heat generating chamber 28 and the front surface of the rotor 39 tends to be recovered in the control chamber CR by way of the communicating hole 39*a*. The silicone oil which has been recovered in the control chamber CR is not supplied to the heat generating chamber 28 through the second supply hole 34*a*, the first supply hole 23*d*, and the supply groove 23*c*. When the silicone oil is recovered in the control chamber CR, the value of heat generated in the space between the wall surface of the heat generating chamber 28 and the outer surface of the rotor 39 is lessened (the heating power is decreased), and the heating performance is lessened. In this case, the air remaining in the upper surplus spaces 31, which has been expanded and pressurized by the heat generation of the silicone oil, smoothly delivers the silicone oil to the control chamber CR.

Thus, this viscous heater can smoothly exercise heating power control while attaining other functions and advantages in the same way as in the first preferred embodiment.

The Third Preferred Embodiment

Figure 4:
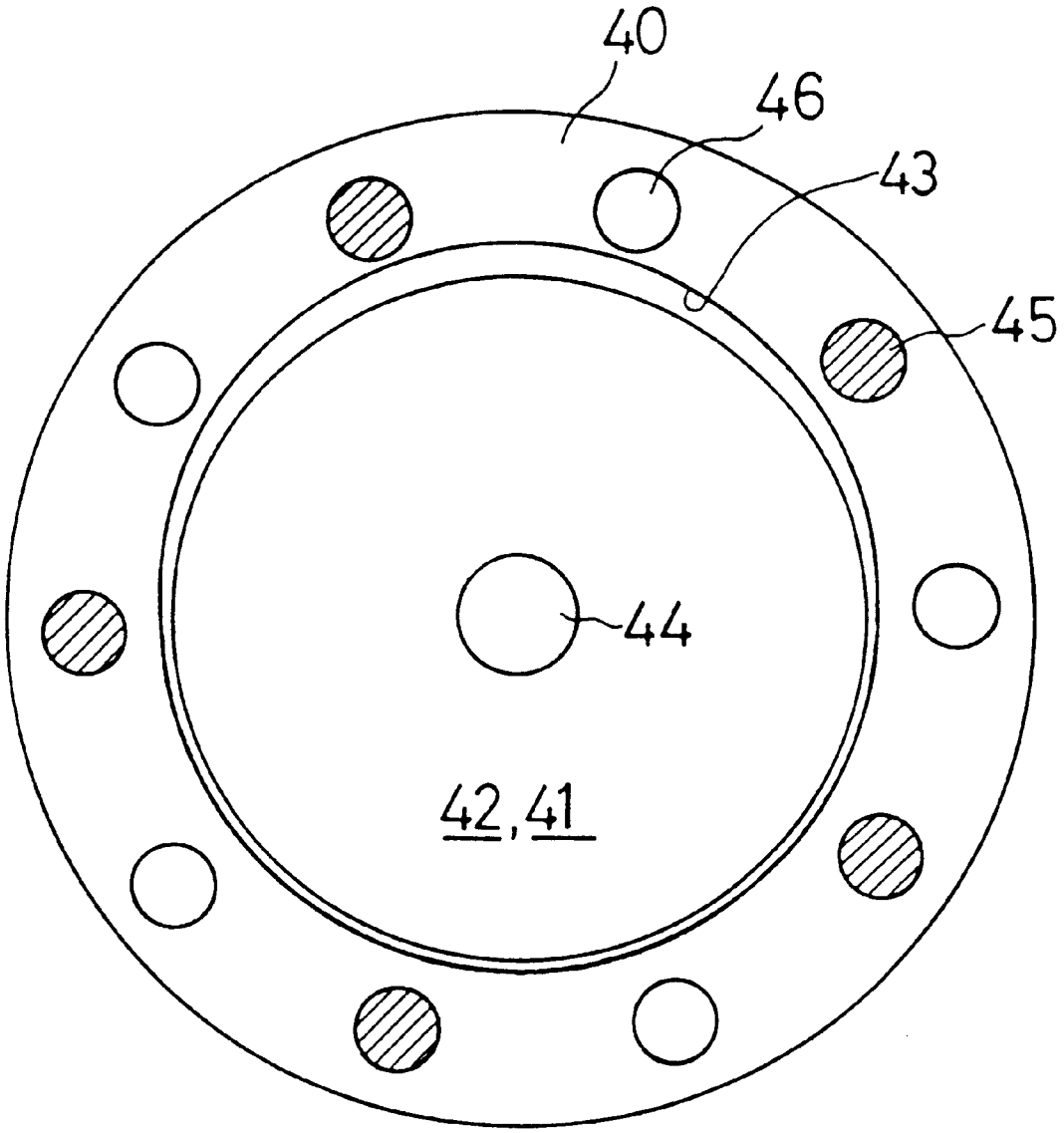
FIG. 4 is a cross-section view of a viscous heater according to a third preferred embodiment, which is similar to that of FIG. 2.

A viscous heater of the third preferred embodiment is different from those of the first and second preferred embodiments in the shape of surplus spaces, as shown in FIG. 4.

In a front plate 40, there is a heat generating chamber 42 the lower portion of which has the shape of a concentric arc with a rotor 41 and the upper portion of which has the shape of an eccentric arc. Thus, the heat generating chamber 42 integrally has a crescent surplus space 43 in an upper position. Note that 44 designates a driving shaft, and 45 designates through bolts, and 46 designates water passages. Other structures of the viscous heater of this preferred embodiment are similar to those of the first or second preferred embodiment.

The viscous heater employing this type of front plate 40 can also attain similar functions and advantages to those of the first or second preferred embodiment.

It is apparent that the construction of the surplus space is not limited to those of the first to third preferred embodiments, and that various modifications which come within the meaning of the claims are possible.

We claim:

1. A viscous heater, comprising:

a front housing and a rear housing forming therein a heat-generating chamber, and a radiator chamber which adjoins said heat-generating chamber for circulating fluid therethrough;

a driving shaft held rotatably by said front housing by way of a bearing device; and a rotor disposed in said heat-generating chamber and rotatable by said driving shaft;

wherein a wall surface of said heat-generating chamber and an outer surface of said rotor define a space for accommodating viscous fluid, and rotation of said rotor causes generation of heat by the viscous fluid, and at least one of said front housing and said rear housing is provided with a surplus space which communicates with said heat-generating chamber and permits thermal expansion of said viscous fluid.

2. A viscous heater according to claim 1, wherein said heat-generating chamber and said surplus space are held in a closed state and enclose said viscous fluid.

3. A viscous heater according to claim 2, wherein said surplus space is formed in an outer circumferential region of said heat-generating chamber.

4. A viscous heater according to claim 3, wherein said surplus space is formed by enlarging a space between an inner circumferential wall surface of said heat-generating chamber and an outer circumferential surface of said rotor.

5. A viscous heater according to claim 4, wherein said surplus space is formed above said rotor.

6. A viscous heater according to claim 1, wherein said front housing and said rear housing are fastened together in an outer circumferential region of said heat-generating chamber by a plurality of through bolts, and surplus spaces are disposed between said respective through bolts.

7. A viscous heater according to claim 1, wherein said radiator chamber comprises a front radiator chamber formed in front of said heat generating chamber, and a rear radiator chamber which communicates with said front radiator chamber by a plurality of axially-extending fluid passages and which is formed at the back of said heat-generating chamber, and surplus spaces are disposed between said respective fluid passages.

8. A viscous heater according to claim 1, wherein at least one of said front housing and said rear housing comprises a plate one axial-end surface of which forms one wall surface of said heat generating chamber and the other axial-end surface of which forms one wall surface of said radiator chamber, and a housing body constituting the rest of said housing, said rotor has the shape of a plate, and said plate, said housing body, and the other of said front housing and said rear housing are respectively stacked.

9. A viscous heater according to claim 1, wherein said rear housing has a control chamber which communicates with a central region of said heat-generating chamber, and in decreasing the heating power, recovery of said viscous fluid from said heat-generating chamber to the control chamber is conducted at least by the Weissenberg effect of said viscous fluid.

10. A viscous heater according to claim 1, wherein said surplus space is formed in an outer circumferential region of said heat-generating chamber.

11. A viscous heater according to claim 10, wherein said surplus space is formed above said rotor.

* * * * *